US006478013B1

(12) United States Patent
Boecking

(10) Patent No.: US 6,478,013 B1
(45) Date of Patent: Nov. 12, 2002

(54) FUEL INJECTION VALVE AND METHOD FOR OPERATING A FUEL INJECTION VALVE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/889,528

(22) PCT Filed: Sep. 22, 1999

(86) PCT No.: PCT/DE99/03020

§ 371 (c)(1),
(2), (4) Date: Nov. 13, 2001

(87) PCT Pub. No.: WO00/42313

PCT Pub. Date: Jul. 20, 2000

(30) Foreign Application Priority Data

Jan. 18, 1999 (DE) ..... 199 01 711

(51) Int. Cl.[7] ..... F02M 37/04
(52) U.S. Cl. ..... 123/467; 123/498
(58) Field of Search ..... 123/467, 498

(56) References Cited

U.S. PATENT DOCUMENTS

| | | | | |
|---|---|---|---|---|
| 4,725,002 A | | 2/1988 | Trachte | |
| 5,875,764 A | * | 3/1999 | Kappel et al. | 123/467 |
| 6,062,533 A | * | 5/2000 | Kappel et al. | 251/57 |
| 6,213,098 B1 | * | 4/2001 | Kato et al. | 123/467 |
| 2001/0035465 A1 | * | 11/2001 | Shinogle et al. | 239/96 |

FOREIGN PATENT DOCUMENTS

| | | |
|---|---|---|
| DE | 43 06 073 | 6/1994 |
| DE | 195 00 706 | 7/1996 |
| GB | 2 094 940 | 9/1982 |
| JP | 07 227 091 | 8/1995 |

* cited by examiner

*Primary Examiner*—Thomas N. Moulis
(74) *Attorney, Agent, or Firm*—Kenyon & Kenyon

(57) ABSTRACT

A fuel injector (1), in particular a fuel injector for fuel injection systems of internal combustion engines, has a piezoelectric or magnetostrictive actuator (3) and a valve closing body (12) which can be actuated by the actuator (3) via an actuating path (6, 24, 10, 9), the valve closing body (12) working together with a valve seat surface (13) to form a sealing seat. A gap (24) is formed in the actuating path (6, 24, 10, 9) in the non-energized rest state of the actuator (3).

10 Claims, 1 Drawing Sheet

Fig.1
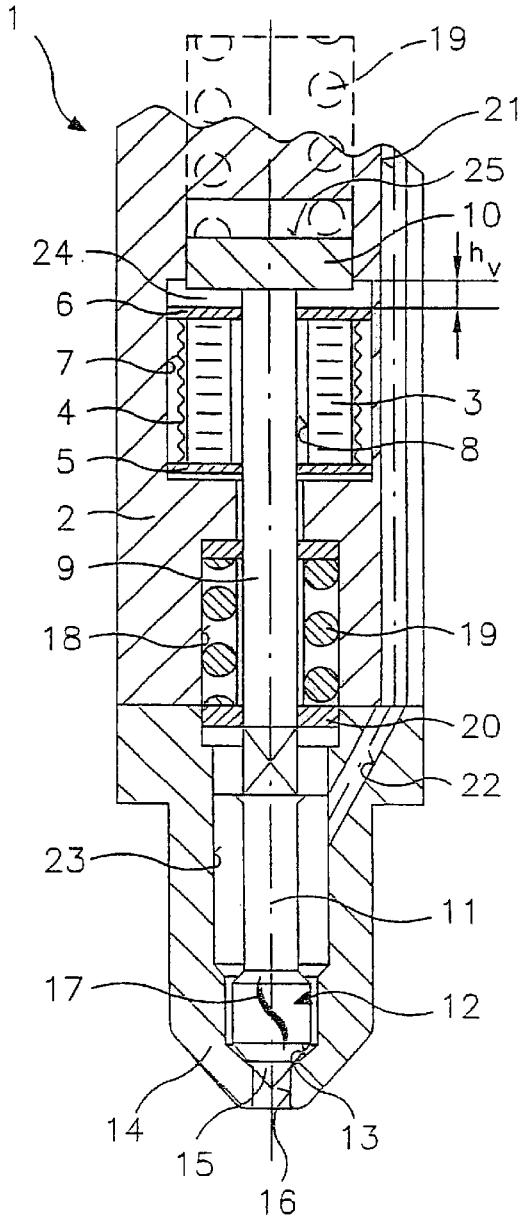
Fig.2
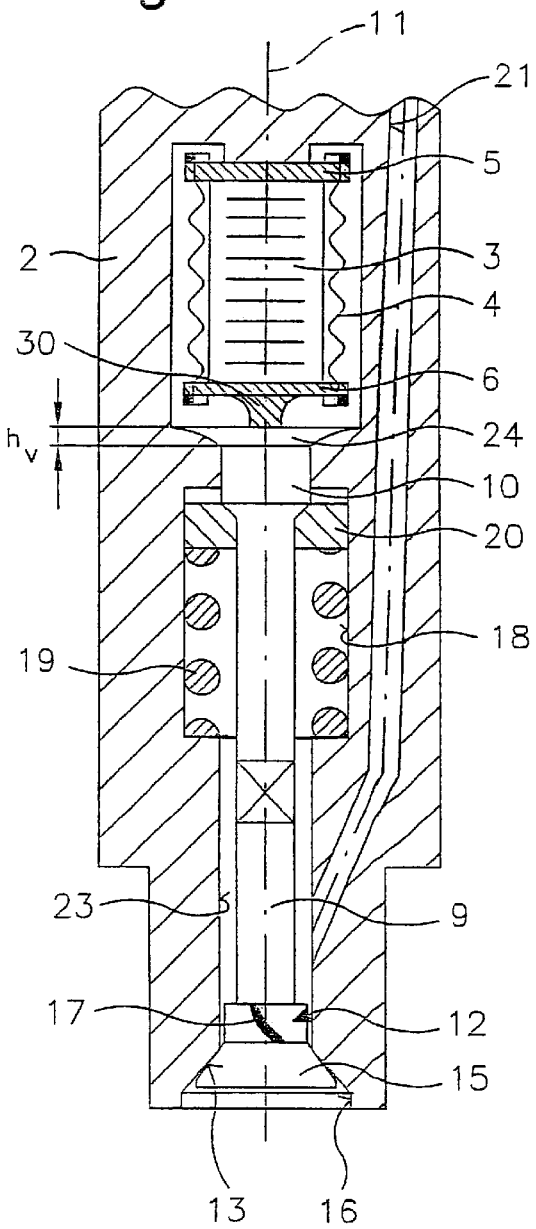
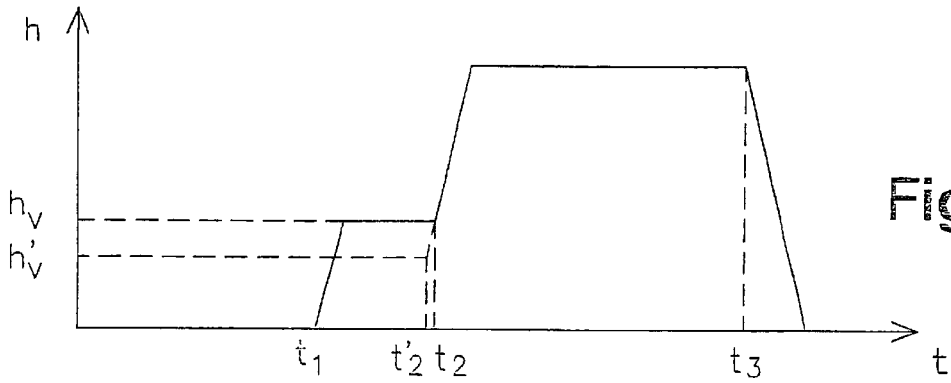
Fig.3

FUEL INJECTION VALVE AND METHOD FOR OPERATING A FUEL INJECTION VALVE

BACKGROUND INFORMATION

The present invention is based on a fuel injector according to the definition of the species of Claim 1 and a method of operating a fuel injector according to the definition of the species of Claim 7.

German Patent Application 195 00 706 A1 describes a fuel injector of the type defined in the main claim. In the fuel injector described in this document, a piezoelectric actuator is provided for actuating a valve needle connected to a valve closing body. The valve closing body works together with a valve seat surface to form a sealing seat. The fuel injector can be designed as either an outward-opening or an inward-opening fuel injector. The piezoelectric actuator formed by a plurality of stacked piezoelectric layers generates relatively high displacement forces, but relatively short displacement paths. Therefore, the known document proposes that a hydraulic step-up mechanism be provided to magnify the displacement path between the valve needle and the piezoelectric actuator and transmitted to the valve needle. The hydraulic step-up mechanism provides temperature compensation of the piezoelectric actuator at the same time.

As known, the piezoelectric actuator is subject to non-negligible temperature-dependent elongation. This temperature-dependent elongation of the piezoelectric actuator is, however, relatively slow compared to the actuator's actuating stroke which results in the opening of the fuel injector. Therefore, the temperature-dependent elongation of the actuator is a quasi-static process. The associated displacement of the hydraulic medium does not result in opening of the fuel injector, but the displaced hydraulic medium is vented quasi-statically via the guide gaps of the hydraulic step-up mechanism.

In some applications the operating stroke of the actuator does not have to be hydraulically stepped up, since the actuator generates sufficient stroke for opening the fuel injector. For such applications, the arrangement of a hydraulic step-up mechanism for the purpose of temperature compensation only would be too cost-intensive and complicated. Furthermore, it is disadvantageous that a special hydraulic medium must be used for the hydraulic step-up mechanism, which may leak out over time. This may negatively affect the operation of the step-up mechanism and the service life of the fuel injector.

German Patent 43 06 073 C1 describes a fuel injector having a piezoelectric actuator in a different design. Also in this fuel injector, temperature is compensated via a hydraulic step-up mechanism. German Patent Application 35 33 085 A1 describes a fuel injector without a hydraulic step-up mechanism, but also without any temperature compensation.

ADVANTAGES OF THE INVENTION

The fuel injector according to the present invention having the features of Claim 1 has the advantage over the related art that the piezoelectric or magnetostrictive actuator is temperature compensated due to the gap arranged in the actuating path without the need for an expensive hydraulic step-up mechanism. The gap arranged in the actuating path between the actuator and the valve closing body allows undisturbed thermal elongation of the actuator without the thermal elongation resulting in opening of the fuel injector.

The method according to the present invention for operating such a fuel injector having the features of Claim 7 has the advantage that, in order to open the fuel injector, the gap provided in the actuating path does not have to be overcome. Instead, the temperature-dependent elongation of the actuator is continuously measured before each actuating stroke of the actuator or in fixedly predefined time intervals. When the actuator is actuated, initially a first electrical actuating voltage is applied to it, which causes the actuator to expand so that the gap ideally disappears or is at least minimized. Subsequently a higher second electrical actuating voltage is applied to the actuator, which results in immediate opening of the fuel injector.

The measures given in the subclaims provide advantageous refinements of and improvements on the fuel injector presented in Claim 1 and the method of operating the fuel injector presented in Claim 7.

The gap is preferably arranged between an actuator flange connected to the actuator and a valve needle connected to the valve closing body. The gap is preferably filled with a gaseous medium, air in particular, which can be rapidly vented when the actuator is operated. The width of the gap is preferably dimensioned such that it is ensured that, when the actuator is in the non-energized rest state, the gap is not bridged due to temperature elongation of the actuator over the entire range of temperatures that may prevail during the operation of the fuel injector. This allows the fuel injector to be operated in a wide range of temperatures.

In an inward-opening fuel injector, the gap is preferably located on the side of the actuator that faces away from the valve closing body, while in an outward-opening fuel injector the gap is preferably located on the side of the actuator that faces the valve closing body.

The temperature-dependent elongation of the actuator can be measured, for example, by measuring the capacitance of the actuator. Since the actuator normally has a plurality of piezoelectric layers which are provided with electrodes, thermal expansion of the piezoelectric actuator results in an increase in the distance between the electrodes and therefore in a decrease in the capacitance. The temperature-dependent elongation of the actuator can then be calculated back from the measured capacitance. As an alternative, it may be sufficient to measure the temperature of the actuator if the coefficient of thermal expansion of the actuator is known with sufficient accuracy. Then the temperature-dependent elongation of the actuator at the measured temperature can then be calculated back from the actuator temperature measurement. Measuring the capacitance of the actuator and the temperature of the actuator can be combined to improve accuracy.

DRAWING

Embodiments of the present invention are shown in a simplified manner in the drawing and described in detail in the description that follows.

FIG. 1 shows a section through a first embodiment of the fuel injector according to the present invention;

FIG. 2 shows a section through a second embodiment of the fuel injector according to the present invention;

FIG. 3 shows a time diagram to illustrate the method according to the present invention of operating the fuel injector according to the present invention.

DESCRIPTION OF THE EXEMPLARY EMBODIMENTS

FIG. 1 shows an axial section of one embodiment of fuel injector 1 according to the present invention. Fuel injector 1 is well suited, in particular, for direct injection of fuel, in particular of gasoline, into the combustion chamber of an internal combustion engine, preferably having mixture compression and spark ignition.

A piezoelectric actuator 3, surrounded by a pre-tensioning element 4 in the form of a sleeve, is integrated in a housing body 2. Piezoelectric actuator 3 is secured between a first actuator flange 5 and a second actuator flange 6 via pre-tensioning element 4 connected to actuator flanges 5 and 6. Actuator 3, actuator flanges 5 and 6, and pre-tensioning element 4 are inserted in a cylindrical recess 7 of housing body 2. Actuator 3 is supported by housing body 2 via first actuator flange 5.

In this embodiment, actuator 3 is designed in the form of a sleeve. Both actuator 3 and actuator flanges 5 and 6 have a central opening 8, which is traversed by a valve needle 9. Valve needle 9 has a valve needle flange 10, which is used as a stop for second actuator flange 6.

In this embodiment, a valve closing body 12, which forms a sealing seat with a valve seat surface 13 molded on a valve seat carrier 14, is designed as one piece with valve needle 9 which extends concentrically to central axis 11. Valve closing body 12 has a conical surface 15, which matches conical valve seat surface 13. A spray opening 16 is connected to valve seat surface 13 in the direction of injection. Valve closing body 12 has at least one swirl groove 17 for better distribution of the fuel.

A spring seat 18 is provided on the spray end of housing body 2 for a restoring spring 19, which acts on valve needle 9 on a flange 20 connected to valve needle 9 and presses valve closing body 12 into its closed position.

Fuel is supplied via a fuel line 21 formed in housing body 2, which is connected to a fuel line 22 formed in valve seat carrier 14 opening into an axial bore hole 23 in valve seat body 14.

According to the present invention, a gap 24 is provided in the actuating path between piezoelectric actuator 3 and valve closing body 12. In the embodiment illustrated in FIG. 1, gap 24 is located between second actuator flange 6 and valve needle flange 10. However, gap 24 can basically also be located at some other point in the actuating path between actuator 3 and valve closing body 12, for example, between valve needle 9 and valve closing body 12.

Gap 24 is used for temperature compensation of piezoelectric actuator 3. As is known, actuator 3 made of piezoelectric ceramic layers is subject to a non-negligible thermal elongation. If actuator 3 were directly connected to valve needle 9 with second actuator flange 6 resting directly on valve needle flange 10 when actuator 3 is in the non-energized rest state, fuel injector 1 would not only open when actuator 3 is energized, but also due to a thermal elongation of actuator 3. In contrast, in fuel injector 1 according to the present invention, a thermal elongation of actuator 3 results only in a reduction in gap width $h_v$ of gap 24, rather than in valve closing body 12 being lifted from valve seat surface 13.

Gap width $h_v$ of gap 24 must be designed so that it is ensured that, when actuator 3 is in the non-energized rest state, gap 24 is not bridged due to temperature elongation of actuator 3 over the entire range of temperatures that may prevail during the operation of fuel injector 1. Gap 24 if filled with a gaseous medium, preferably with the ambient air of fuel injector 1. The air in gap 24 can be rapidly vented, for example, via a venting bore hole, when actuator 3 is operated.

Restoring spring 19 may also act on end face 25 of valve needle flange 10 facing away from actuator 3 as an alternative, which is indicated in FIG. 1 with a broken line.

While FIG. 1 shows the present invention on an inward-opening fuel injector 1, FIG. 2 shows an outward-opening fuel injector 1 according to the present invention. Elements described previously are labeled with the same reference symbols, so that the description of these elements is not repeated.

In contrast with the embodiment illustrated in FIG. 1, valve closing body 12 in the embodiment illustrated in FIG. 2 is arranged on valve needle 9 so that conical surface 15 of valve closing body 12 rests on valve closing surface 13 on the outside. In FIG. 2, restoring spring 19 acts on valve needle 9 upward via flange 20 and thus causes valve closing body 12 to be restored into its closing position.

First actuator flange 5 strikes against housing body 2 so that in FIG. 2 second actuator flange 6 moves downward when piezoelectric actuator 3 is operated and, after bridging gap 24, strikes against valve needle flange 10 with a projection 30.

The function of gap 24 includes, also in the embodiment of FIG. 2, the temperature compensation of actuator 3 as described previously. Gap width $h_v$ in the embodiment shown in FIG. 2 as well should therefore be dimensioned so that it is ensured that, when actuator 3 is in the non-energized rest state, gap 24 is not bridged due to temperature elongation of actuator 3 over the entire range of temperatures that may prevail during the operation of fuel injector 1.

The method according to the present invention for operating fuel injector 1 according to the present invention is now explained in detail with reference to FIG. 3. FIG. 3 shows stroke h of actuator 3 as a function of time t.

According to the present invention, the thermal elongation of actuator 3 is measured. This measurement can either be performed continuously or it can be repeated at the beginning of each injection interval or in fixedly predefined time intervals. In the simplest case, the thermal elongation is measured by detecting the temperature of actuator 3 using a suitable sensor, for example, a PTC resistor. If the coefficient of thermal expansion of the piezoelectric material of which actuator 3 is made is known with sufficient accuracy, the temperature-dependent instantaneous length of actuator 3 can be computed back from the measured temperature.

The temperature-dependent length of actuator 3 can, however, also be determined by measuring the capacitance of actuator 3. Piezoelectric actuator 3 is generally composed of a plurality of piezoelectric ceramic layers, which are arranged between electrodes and are acted upon by an axial electrical field. The thermal expansion of the piezoelectric layers causes the distance between the electrodes to increase, whereby the capacitance of piezoelectric actuator 3 decreases. Thus, the instantaneous temperature-dependent length of actuator 3 can be computed back from the measured temperature-dependent capacitance of actuator 3. Measuring the temperature and the capacitance of actuator 3 can also be combined to increase accuracy. The capacitance of actuator 3 can be measured using a charge-controlled electronic circuit or a bridge circuit, in which the capacitance of actuator 3 is compared with a reference capacitance.

The temperature-dependent residual gap width $h_v$ can be determined from the indirectly measured temperature-dependent elongation of actuator 3 in the non-energized rest state of actuator 3. Before the actual injection interval according to the present invention, a first actuating voltage is applied to actuator 3 so that in the ideal case gap 24 disappears or is at least minimized. This first electrical actuating voltage is adapted to measured temperature-dependent gap width $h_v$; the greater gap width $h_v$, the higher is this first actuating voltage.

FIG. 3 shows first electrical actuating voltage being applied in time interval $t_1$ to $t_2$. Actuator 3 travels through stroke $h_v$ which is equal to the previously determined gap width $h_v$. Measured gap width $h_v'$ may be smaller at some other temperature, which is shown in FIG. 3 with a broken line. Then actuator stroke $h_v'$ caused by first electrical actuating voltage can also be smaller accordingly.

In time interval $t_2$ to $t_3$ and $t_2'$ to $t_3$, a second actuating voltage that is higher than first actuating voltage is applied to actuator 3, so that actuator 3 expands further and valve closing body 12 is lifted from valve seat surface 13, opening fuel injector 1. Thus, during this injection interval, fuel is injected by fuel injector 1. At time $t_3$, the second actuating voltage is turned off, so that actuator 3 returns to its rest state.

With the method according to the present invention it is achieved that the time of injection is largely independent of gap width $h_v$ and, in particular, the time needed by actuator 3 to overcome gap width hv has no effect on the time of injection and on the length of the injection interval.

What is claimed is:

1. A fuel injector, comprising:

one of a piezoelectric actuator and a magnetostrictive actuator;

an actuating path;

a valve seat surface; and a valve closing body that can be actuated by the one of the piezoelectric actuator and the magnetostrictive actuator via the actuating path, wherein:

the valve closing body works together with the valve seat surface to form a sealing seat, a gap is formed in the actuating path in a non-energized rest state of the one of the piezoelectric actuator and the magnetostrictive actuator due to which the one of the piezoelectric actuator and the magnetostrictive actuator has no effective contact on the valve closing body to lift the valve closing body from the valve seat surface, the gap is formed outside hydraulic areas and lines of the fuel injector, and the gap is filled exclusively with a gaseous medium that can be rapidly vented when the one of the piezoelectric actuator and the magnetostrictive actuator is operated.

2. The fuel injector according to claim 1, wherein:

the fuel injector is for a fuel injection system of an internal combustion engine.

3. The fuel injector according to claim 1, wherein:

the gaseous medium includes air.

4. The fuel injector according to claim 1, wherein:

the actuating path includes:

an actuator flange connected to the one of the piezoelectric actuator and the magnetostrictive actuator, and a valve needle connected to the valve closing body, and the gap is arranged between the actuator flange and the valve needle.

5. The fuel injector according to claim 1, wherein:

a width of the gap is dimensioned such that when the one of the piezoelectric actuator and the magnetostrictive actuator is in the non-energized rest state, the one of the piezoelectric actuator and the magnetostrictive actuator has no effective contact on the valve closing body to lift the valve closing body from the valve seat surface, even at a maximum temperature elongation of the one of the piezoelectric actuator and the magnetostrictive actuator over an entire range of temperatures that may prevail during an operation of the fuel injector.

6. The fuel injector according to claim 1, wherein:

the fuel injector is an inward-opening fuel injector, and the gap is located on a side of the one of the piezoelectric actuator and the magnetostrictive actuator that faces away from the valve closing body.

7. The fuel injector according to claim wherein:

the fuel injector is an outward-opening fuel injector, and the gap is located on a side of the one of the piezoelectric actuator and the magnetostrictive actuator that faces the valve closing body.

8. A method of operating a fuel injector, comprising the steps of:

measuring a temperature-dependent linear extension of one of a piezoelectric actuator and a magnetostrictive actuator in a non-energized rest state of the one of the piezoelectric actuator and the magnetostrictive actuator;

applying a first electrical actuating voltage to the one of the piezoelectric actuator and the magnetostrictive actuator as a function of the measured temperature-dependent linear extention of the one of the piezoelectric actuator and the magnetostrictive actuator, the first electrical actuating voltage being such that a gap formed in an actuating path in the non-energized rest state of the one of the piezoelectric actuator and the magnetostrictive actuator one of disappears and is at least minimized; and applying a second electrical actuating voltage to the one of the piezoelectric actuator and the magnetostrictive actuator to open the fuel injector during an injection interval.

9. The fuel injector according to claim 7, wherein:

the step of measuring the temperature-dependent linear extension of the one of the piezoelectric actuator and the magnetostrictive actuator includes the step of measuring a capacitance of the one of the piezoelectric actuator and the magnetostrictive actuator.

10. The fuel injector according to claim 7, wherein:

the step of measuring the temperature-dependent linear extension of the one of the piezoelectric actuator and the magnetostrictive actuator includes the step of measuring a temperature of the one of the piezoelectric actuator and the magnetostrictive actuator.

* * * * *

UNITED STATES PATENT AND TRADEMARK OFFICE

CERTIFICATE OF CORRECTION

PATENT NO. : 6,478,013 B1 
DATED : November 12, 2002
INVENTOR(S) : Friedrich Boecking It is certified that error appears in the above-identified patent and that said Letters Patent is hereby corrected as shown below:

Title page,
Item [57], ABSTRACT,
Delete "(1) (3) (12) (3) (6, 24, 2, 10, 9) (12) (13) (24) (6, 24, 10, 9) (3)".

Column 1,
Line 6, change "is based on" to -- relates to a --
Line 8, delete "according to the definition of the species of Claim 7"
Line 49, delete "C1"
Line 53, delete "A1"
Line 55, change "ADVANTAGES" to -- SUMMARY--

Column 2,
Delete lines 12 to 15
Delete lines 50 to 54
Line 50, insert -- BRIEF DESCRIPTION OF THE DRAWINGS --
Lines 56 and 58, change "invention;" to -- invention. --
Line 63, change "DESCRIPTION OF THE EXEMPLARY EMBODIMENTS" to -- DETAILED DESCRIPTION --

Column 3,
Line 56, change "must be designed so that it is ensured that" to -- ensures that --

Signed and Sealed this

Eighteenth Day of November, 2003

JAMES E. ROGAN
*Director of the United States Patent and Trademark Office*